US006636182B2

(12) United States Patent
Mehltretter

(10) Patent No.: US 6,636,182 B2
(45) Date of Patent: Oct. 21, 2003

(54) STRUCTURAL ANTENNA FOR FLIGHT AGGREGATES OR AIRCRAFT

(75) Inventor: Ludwig Mehltretter, Riemerling (DE)

(73) Assignee: EADS Deutschland GmbH, Ottobrunn (DE)

( * ) Notice: Subject to any disclaimer, the term of this patent is extended or adjusted under 35 U.S.C. 154(b) by 0 days.

(21) Appl. No.: 09/985,314

(22) Filed: Nov. 2, 2001

(65) Prior Publication Data

US 2002/0089457 A1 Jul. 11, 2002

(30) Foreign Application Priority Data

Nov. 2, 2000 (DE) ..... 100 54 332

(51) Int. Cl.[7] ..... H01Q 1/28
(52) U.S. Cl. ..... 343/705; 343/708
(58) Field of Search ..... 343/708, 792, 343/705, 790, 791

(56) References Cited

U.S. PATENT DOCUMENTS 3,039,095 A 6/1962 Josephson ..... 343/708
4,371,875 A * 2/1983 Keydel ..... 343/708
5,191,351 A * 3/1993 Hofer et al. ..... 343/895

FOREIGN PATENT DOCUMENTS

DE 2212647 9/1973

* cited by examiner

*Primary Examiner*—James Clinger
(74) *Attorney, Agent, or Firm*—Crowell & Moring LLP

(57) ABSTRACT

A folded microstrip antenna for a flight aggregate or aircraft can be arranged around edges of thin structural parts, such as wings, tail units or control flaps, such that its surface is identical with the structure and folding takes place at the edge of the structure. The antenna is constructed such that its characteristic impedance is much higher at the folding edge than at ends of the structural antenna away from the edge. As a result, an approximately omnidirectional characteristic can be achieved.

17 Claims, 4 Drawing Sheets

STRUCTURAL ANTENNA FOR FLIGHT AGGREGATES OR AIRCRAFT

Figure 1A:
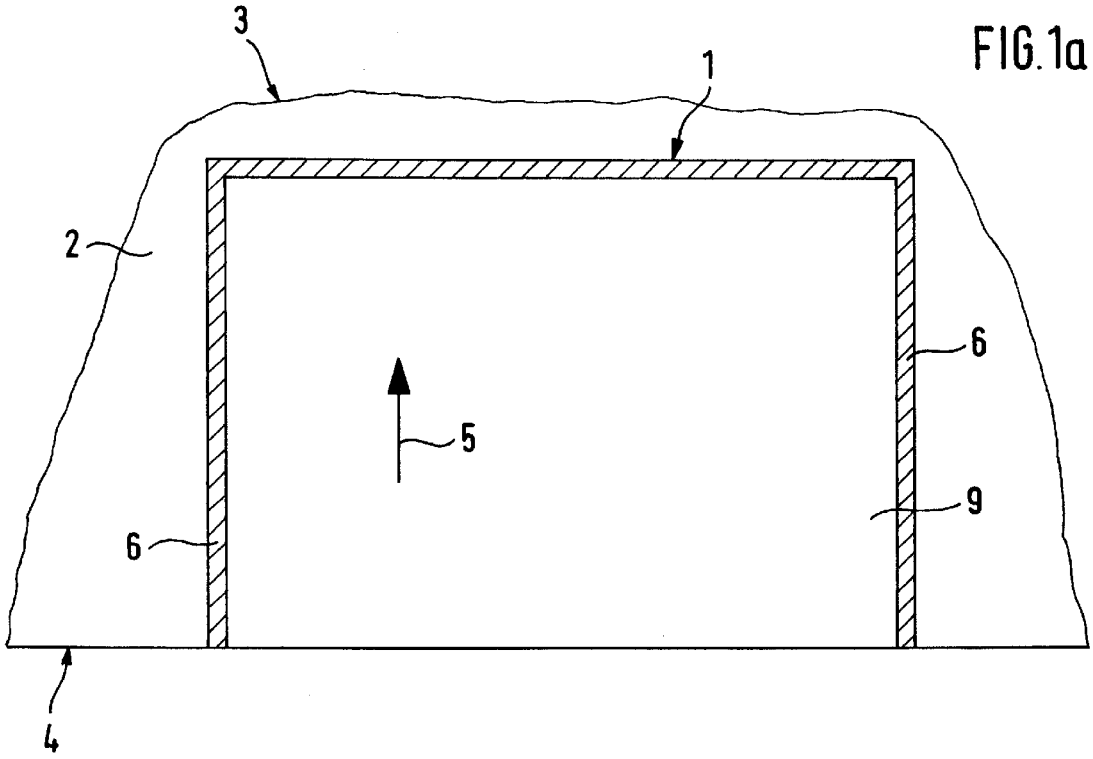

This application claims the priorities of German application 100 54 332.4, filed Nov. 2, 2000, and German application 101 51 288.0, filed Oct. 22, 2001, the disclosures of which are expressly incorporated by reference herein.

BACKGROUND AND SUMMARY OF THE INVENTION

The present invention relates to a structural antenna for a flight aggregate or aircraft having an approximately omnidirectional radiation characteristic. The structural antenna is arranged as a conductive element on a non-conductive layer which forms a base layer of a surface of an aerodynamically effective area of the flight aggregate or aircraft, with the radiating element arranged around a folding edge of the aerodynamically effective area of the flight aggregate or aircraft.

Antennas which are to be used on flight aggregates or aircraft are subjected to a number of demands. If possible, the contour of a flight aggregate or aircraft should not be influenced to such an extent that aerodynamic relationships, and thus flying characteristics, change significantly. The arrangement and the fastening of an antenna should be in accordance with the mechanical construction of the structural parts, and the mechanical stability of the structure must not be impaired. If possible, a radar backscattering cross-section should be changed only slightly.

Because antenna installation sites in flight aggregates or aircraft are very limited, it is increasingly common to install antennas in wings, tail units or pertaining control flaps. The use of antennas in these very narrowly constructed elements is problematic because the radiation characteristics in edge directions are limited considerably, since the apertures are small in these directions.

U.S. Pat. No. 5,191,351 describes a number of folded broadband antennas with symmetrical radiation characteristics. The suggested logarithmic-periodic antennas are basically suited for installation on wing edges, and antenna diagrams of these antennas correspond to the desired demands. Antenna feeding takes place at folding edges, and construction-caused limitations occur. In modern aircraft, the leading edges of wings and tail units consist of sharp, continuous metal edges in order to control stability, meet demands for low radar perceptibility, and ensure sufficient lightening protection for the antennas by low-impedance galvanic connections to the structures. The antennas described in the above-mentioned document cannot meet these requirements.

German Patent Document DE 22 12 647 B2 describes a notch antenna suitable for mounting in aerodynamically effective areas. A problem with this antenna is that the position of the feeding point in the direct proximity of the folding edge permits feeding only for larger angles of partial surfaces of the antenna.

Another variant of an antenna suitable for aerodynamically effective areas is disclosed by U.S. Pat. No. 3,039,095. In this case, the effective area may have sharp edges. Because the antenna elements are arranged on the lateral surfaces of the aerodynamically effective area, losses occur during radiation in the direction of the edges.

It is therefore an object of the invention to provide an antenna construction with an approximately omnidirectional characteristic which is suitable for installation at sharp-edged wing, tail unit, and control surface edges.

According to the invention, this object is achieved by constructing a structural antenna as a plane antenna and integrating the antenna in the surface of an aerodynamically effective area. In the range of the structural antenna, the aerodynamically effective area is formed by the dielectrically effective material of a non-conductive layer. The conductive area of the structural antenna is completely or at least partially surrounded by an area of the non-conductive layer which preferably has the shape of a strip. The structural antenna is fed in the area of the conductive area facing away from the folding edge, so that the current direction extends perpendicular to the folding edge and the characteristic impedance at the folding edge is much lower than in the range of the ends of the structural antenna which are away from the edge. Advantageous features are reflected in the claims.

A structural antenna according to the invention has a number of advantages over the prior art. Feeding does not take place at the folded edge; instead, feeding takes place away from the edge, in an area of the wing or the tail unit, in which, because of an increasing thickness of the structure, antenna installation and connection are facilitated. The possibility of a conductive connection between a structural antenna and a folding edge connected with the structure is a significant advantage in terms of protection against lightening and while manufacturing aircraft which, for reasons of stability, must be equipped with a metallic sharp edge. The sharp edge provides favorable stealth characteristics because a radar backscattering cross-section is impaired only slightly. Furthermore, an improvement can be achieved in this respect by setting edges of the structural antenna defining metallically conductive areas diagonally to the direction of the main threat, which corresponds to the flight direction, and by selecting the distances between the structural antenna and the conductive surface layer of the aerodynamically effective area so that they are very small.

Several embodiments of an antenna structure according to the invention are illustrated in the drawings in schematically simplified manners and will be described.

BRIEF DESCRIPTION OF THE DRAWING FIGURES

Figure 1B:
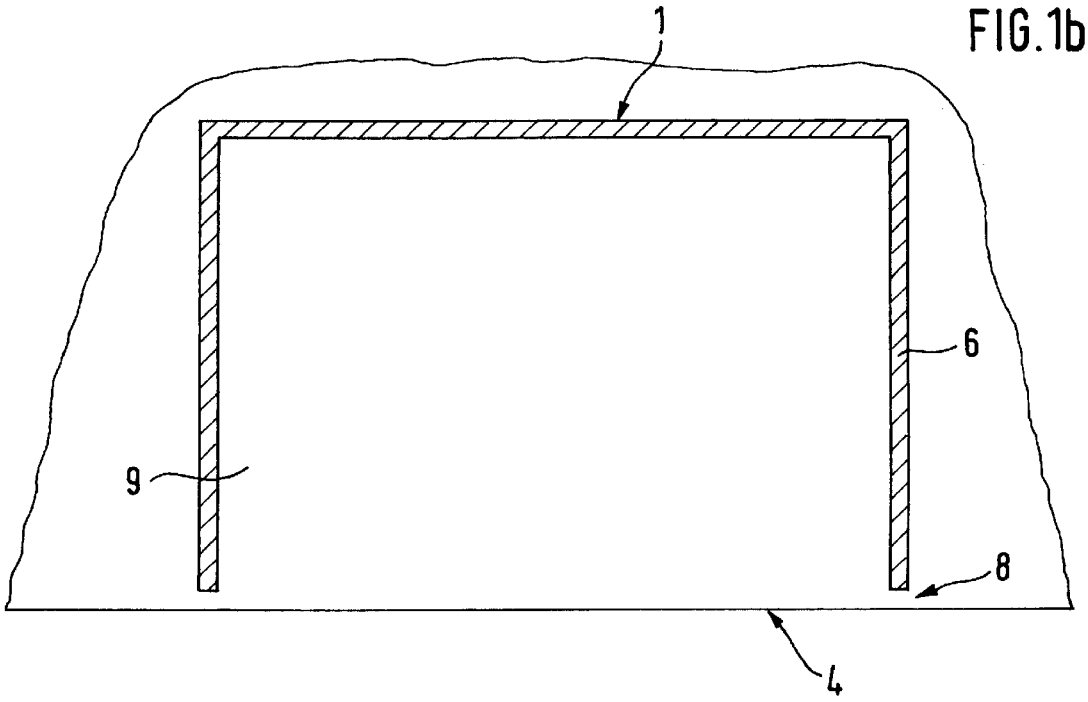

FIG. 1*a* is a top view of a rectangular structural antenna which is arranged at an edge of an aerodynamically effective area;

FIG. 1*b* is a view of an alternative to FIG. 1*a;*

Figure 2A:
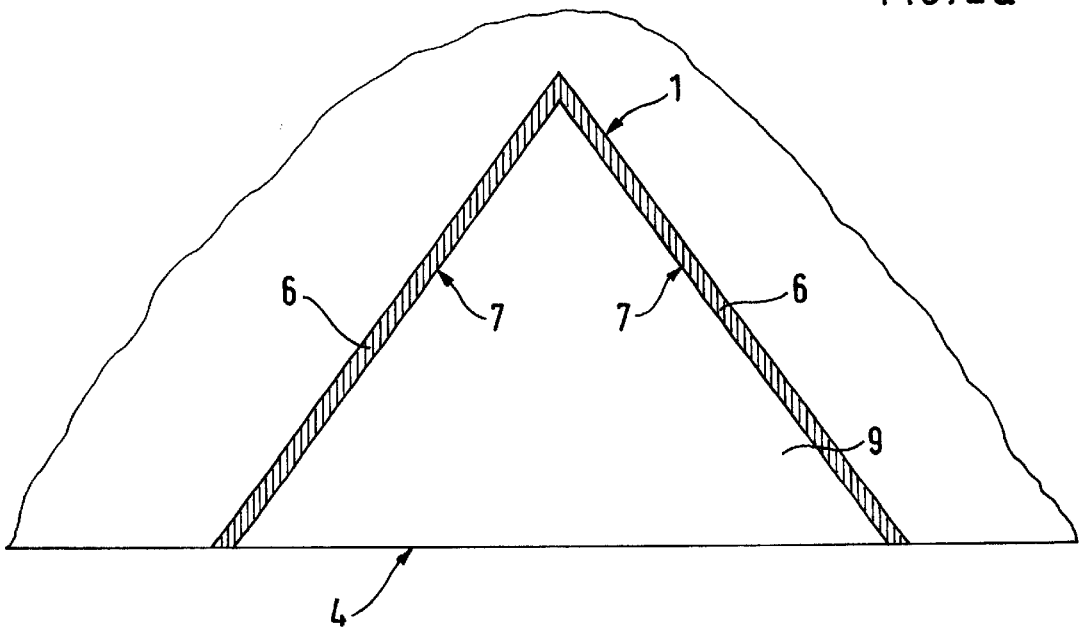
Figure 2B:
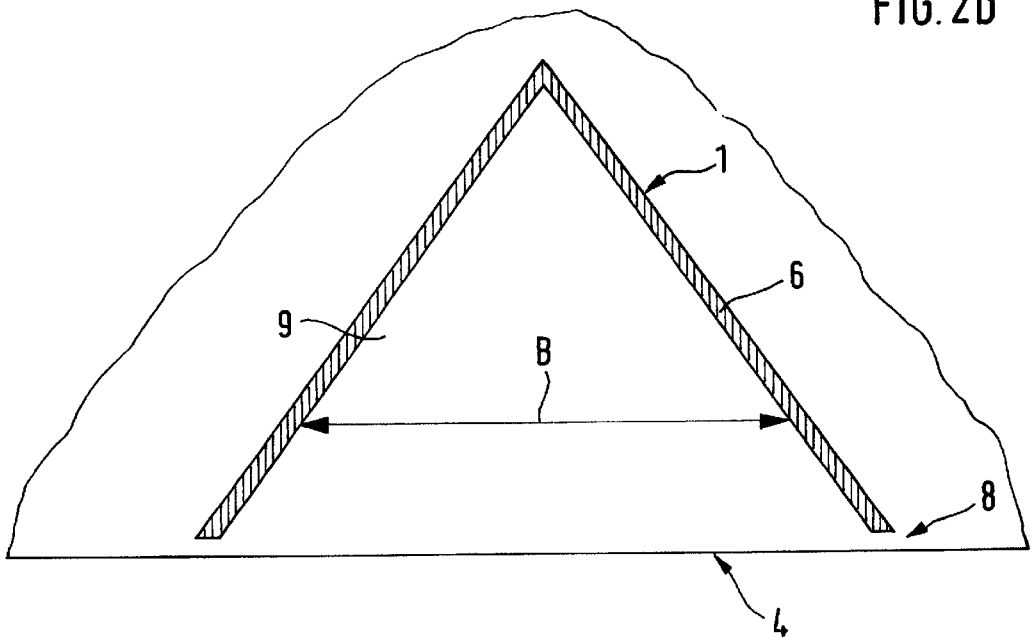

FIG. 2*a* is a view of a rhombic structural antenna;

FIG. 2*b* is a view of an alternative to FIG. 2*a;*

Figure 3A:
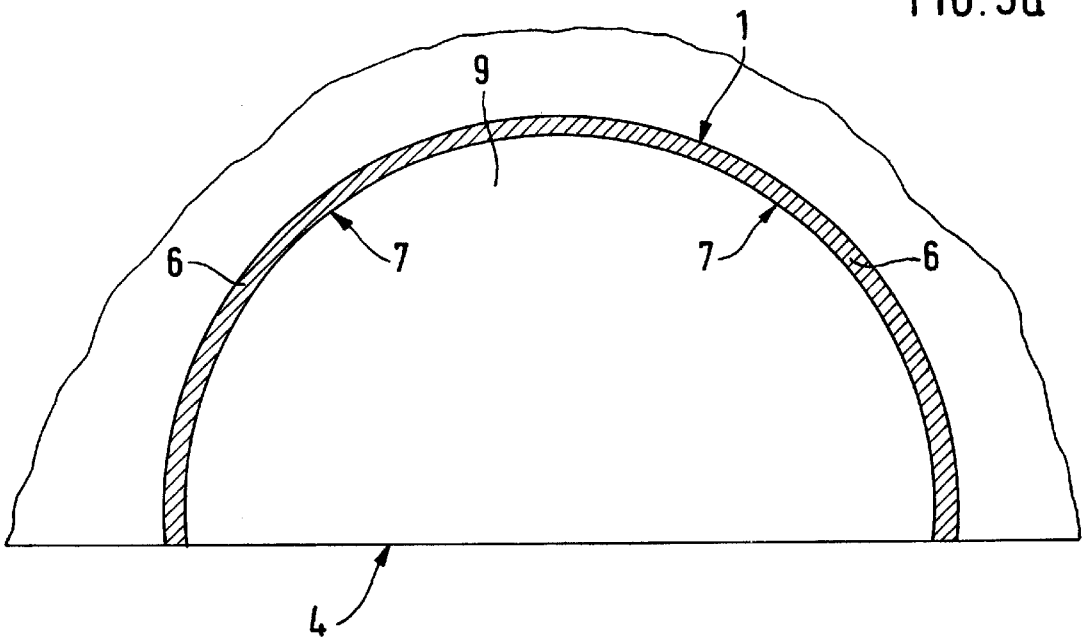
Figure 3B:
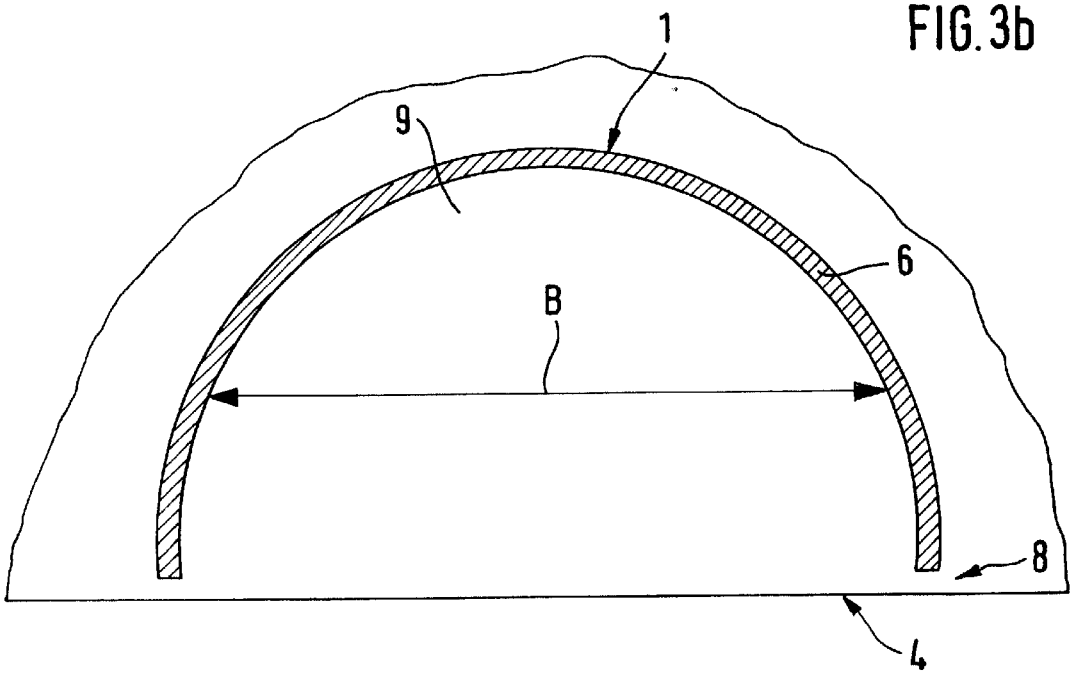

FIG. 3*a* is a view of a circular structural antenna;

FIG. 3*b* is a view of an alternative to FIG. 3*a;*

Figure 4A:
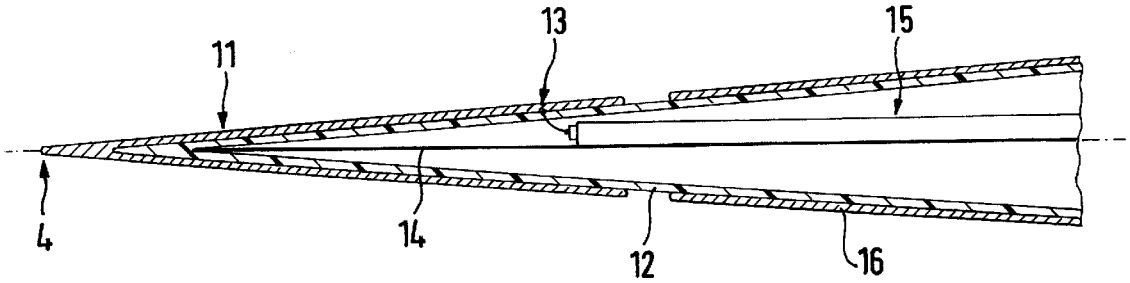
Figure 4B:
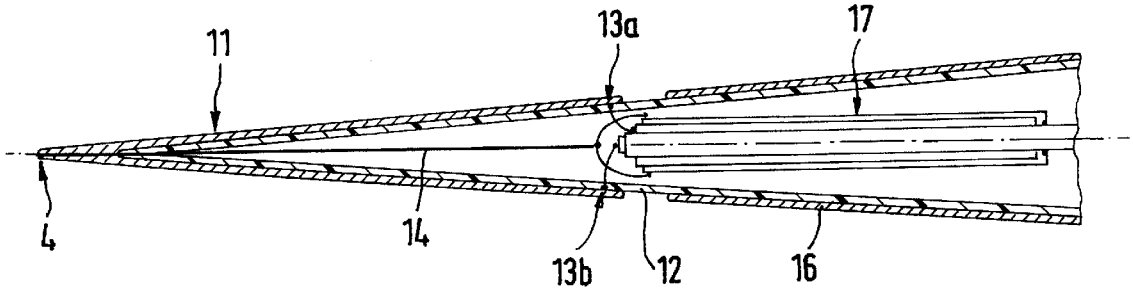

FIG. 4*a* is a view of an asymmetrical feeding of a structural antenna;

FIG. 4*b* is a view of a feeding with compulsory symmetrization; and

Figure 4C:
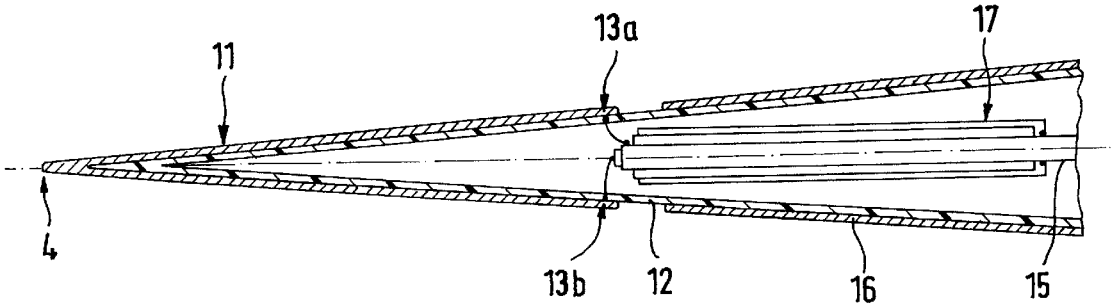

FIG. 4*c* is a view of a feeding without compulsory symmetrization.

DESCRIPTION OF THE PREFERRED EMBODIMENTS

By way of FIG. 1*a* and FIG. 4*a,* a basic construction of a structural antenna according to the invention, which is arranged on an aerodynamically effective area 3, will be explained. An aerodynamically effective area 3, in the form of a wing, a tail unit, or a control flap, forming part of an unmanned flight aggregate or an airplane, has a sharp folding edge 4 around which the structural antenna 1 is arranged. The top view of FIG. 1*a* shows only half of the structural antenna 1; the other half is situated symmetrically to the folding edge 4 on the side of the aerodynamically effective area 3 which is not visible. FIG. 4*a* shows a section through the structure of antenna 1 which pertains to FIG. 1. The aerodynamically effective area, at least in the area of the structural antenna 1, has a base layer 6, 12, made of an electrically insulating material, such as plastic or ceramics. The conductive portion of the structural antenna 1 is a conductive area 9, 11, which can be generated, for example, by metallization of the surface of the non-conductive layer 6, 12 or in the form of a sheet metal part. This conductive area 9, in the embodiment according to FIG. 1*a*, is not electrically connected with the folding edge 4 continuing along the effective area. Instead, as illustrated in FIGS. 1*b*, 2*b* and 3*b*, the conductive area can be conductively connected with the folding edge and thus also with the structure of the flight aggregate or aircraft. If, as illustrated in FIGS. 1*a*, 2*a* and 3*a*, the conductive area is insulated from the folding edge 4, then the conductive area 9 ends in the direct proximity of the folding edge 4. Various ways of feeding the structural antenna 1 are illustrated in FIGS. 4*a*, 4*b* and 4*c*. Feeding takes place on the side of the conductive area 9, 11 facing the non-conductive layer 6. As required, the feeding site is in the upper or lower half of the portion of the structural antenna 1 illustrated in FIG. 1*a*. The structural antenna 1 is at least partially surrounded by an area of the non-conductive layer 6, 12 which, in the embodiment shown, surrounds the conductive area 9, 11 in the form of a strip. Outside the area of the non-conductive layer 6, 12, the structural antenna is surrounded by a conductive area 2 which rests on the non-conductive layer 6, 12.

A basic principle of the structural antenna used here is that a plane resonator with a lateral length of approximately ½ of the operating wavelength $\lambda$ is arranged on a non-conductive base material, such as plastic or ceramics, or above an air space. For calculating the current distribution on the plane resonator, on which the radiation characteristic is based, it is assumed that the reference potential extends at an acute angle with respect to the plane dimension of the resonator. In the present invention, the distance from this potential is reduced from the ends of the structural antenna 1 situated away from the folding edge 4 to the folding edge 4 itself. As a result, the characteristic impedance is large in the area of the ends and is very small in the area of the folding edge 4. Consequently, the current distribution above the antenna also changes inversely proportionally to the characteristic impedance. The current flow 5 in the area of the folding edge 4, that is, the center of the folded structural antenna, becomes larger in comparison to customary patch antennas according to the prior art. As a result, the radiation in the direction of the folding edge 4, which is low per se, will also increase there. Thus, in an imagined plane, which is situated transversely to the aerodynamically effective area in the flight direction, an omnidirectional characteristic is approximately reached. In addition, an increase of the current density in the area of the folding edge 4 can be achieved, since the area covered by the structural antenna 1 is reduced proportionally to its width B with an increasing distance from the edge 4. Corresponding examples are illustrated in FIGS. 2*a*, 2*b*, 3*a*, and 3*b*.

The structural antenna 1 described above has a construction derived from the known microstrip patch antenna, and is illustrated in a schematically simplified manner in FIG. 1*a*. The antenna is folded in its center area so that it surrounds the edge of a wing, a tail unit or a control surface. FIGS. 2*a*, 2*b*, 3*a*, and 3*b* are top views of various constructions of such structural antennas 1. As is customary in such structural antennas, various antenna surface shapes, such as square, rectangular, triangular, rhombic, circular, elliptical or similar shapes, may be used.

If a demand for low radar perceptibility is made on the structural antenna, shapes having edges 7 of the conductive areas 9 of the structural antenna 1 which are set diagonally to the flight direction are preferred. The functionality of these arrangements has been confirmed by good measuring results.

For constructive reasons, in aircraft, the edges of wings, tail units or control surfaces, which essentially are made of plastic, are frequently reinforced with metal rails. For reasons of stability, these metal rails must not be interrupted. The metal rails also must not be replaced by non-conductive plastic elements. This results in conductive connections with the remaining metallized structures by way of the edges. The structural antenna 1 according to the invention has a voltage zero point in the area of the folding edge 4. Consequently, a conductive connection can be implemented between the structural antenna 1 and the metallic folding edge 4, as in the arrangements according to FIGS. 1*a*, 2*a*, 3*a*, and is also not disadvantageous. These embodiments are preferably used because they meet the requirements of folding edge stability and lightening protection. When grounding in the center area of the structural antenna 1 is present, however, a ground-free feeding for avoiding asymmetries by the formation of ground loops is absolutely necessary.

FIG. 4*a* shows the simplest case of an asymmetrical feeding of the metallic planiform antenna 11 at the feeding point 13. The feeding point is situated in the area of the conductive area 11 of the structural antenna 1 which is most remote from the folding edge 4. In this case, the metallic folding edge 4 is insulated from the conductive area of the wing, as illustrated in FIGS. 1*a*, 2*a* and 3*a*. A metallic area 14 is situated in the interior area of the structural antenna. The metallic area extends almost to the folding edge 4 and is connected with the jacket of the coaxial feed line 15, and thus forms the electric reference potential to the conductive area 11. Additionally, the non-conductive area 12 can be provided with a conductive coating 16 extending into the proximity of the structural antenna, in which case a strip of the non-conductive layer 12 is left open.

FIG. 4*b* shows a preferred construction with symmetrical feeding using the Lindenblad $\lambda/4$ folded top 17 which is known per se. As a result of this type of feeding, grounding of the conductive area of the structural antenna 11 on the folding edge 4 is uncritical. According to FIG. 4*b*, feeding takes place by way of the symmetrically arranged feeding points 13*a* and 13*b* which are also situated in the area of the conductive area 11 of the structural antenna 1 which is most remote from the folding edge 4. The metallic folding edge 4 is necessarily symmetrized by way of the $\lambda/4$ folded top 17. The conductive area 11 of the structural antenna is grounded or necessarily symmetrized at the metallic folding edge 4 because feeding by way of the $\lambda/4$ folded top 17 takes place ground-free.

As illustrated in FIG. 4*c*, a metallic area 14, extending as shown in the embodiment illustrated in FIG. 4*b* from the folding edge 4 to the folded top 17, is not necessary. Feeding will then take place directly from the feed line 15 by way of the folded top 17 and the connections 13*a* and 13*b*, which are also situated in the area of the conductive area 11 of the structural antenna 1 which is most remote from the folding edge 4. As a result, a special advantage will be achieved for manufacturing because this metallic area 14 is difficult to place in the wedge-shaped wing structure. Because of the ground-free feeding and the grounding at the folding edge 4, good symmetry is automatically achieved because a zero potential is formed in the area of the imagined symmetry line (illustrated by a dash-dotted line) within the structure. The reduction of the characteristic impedance toward the folding edge 4 takes place in the same manner as in the above-mentioned examples.

Each of FIGS. 1*b*, 2*b* and 3*b* shows a variant of the constructions described above, in which a conductive area 9 is connected at least with a metallic folding edge 4, which extends along the aerodynamically effective area 3, and also with the conductive surface 2 of the aerodynamically effective area 3 itself. Should the non-conductive layer 12 around the structural antenna not be metallized, at least the conductive connection exists between the conductive area 9 and the folding edge 4, which, in turn, has the same potential as the structure.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. A structural antenna for a flight aggregate or aircraft having an approximately omnidirectional radiation characteristic which is arranged as a conductive element on a non-conductive layer which forms a base layer of a surface of an aerodynamically effective area of the flight aggregate or aircraft, the conductive element being arranged around a folding edge of the aerodynamically effective area of the flight aggregate or aircraft so as to define a continuous two-dimensional surface, wherein the structural antenna is integrated as a conductive area in the aerodynamically effective area, the structural antenna being arranged on electrically insulating material of the non-conductive layer, wherein the conductive area is partially or completely surrounded by an area of the non-conductive layer, and wherein the structural antenna is fed in the area of the conductive area facing away from the folding edge and not at the folding edge so that a current direction extends perpendicular to the folding edge and a characteristic impedance at the folding edge is much lower than at ends of the structural antenna located away from the edge.

2. The structural antenna according to claim 1, wherein the conductive area has edges delimiting the continuous two-dimensional surface which are arranged diagonally with respect to the folding edge.

3. The structural antenna according to claim 1, wherein the conductive area is conductively connected on the folding edge with a conductive surface surrounding the structural antenna.

4. The structural antenna according to claim 1, wherein the conductive area is insulated with respect to a conductive surface surrounding the structural antenna which is arranged on the non-conductive layer.

5. The structural antenna according to claim 4, wherein feeding of the structural antenna takes place by way of a symmetrical ground-free feeding line while using a $\lambda/4$ stub sleeve balun.

6. The structural antenna according to claim 5, wherein a metallic area, which is arranged within the structural antenna in a center with respect to the conductive area, is connected with an exterior conductor of the $\lambda/4$ stub sleeve balun and the folding edge.

7. The structural antenna according to claim 5, wherein the conductive area of the structural antenna is fed symmetrically by way of potential-carrying connections and of the symmetrical ground-free feeding line.

8. The structural antenna according to claim 1, wherein the conductive area is conductively connected on the folding edge with a conductive surface surrounding the structural antenna.

9. The structural antenna according to claim 2, wherein the conductive area is conductively connected on the folding edge with a conductive surface surrounding the structural antenna.

10. The structural antenna according to claim 1, wherein the conductive area is insulated with respect to a conductive surface surrounding the structural antenna which is arranged on the non-conductive layer.

11. The structural antenna according to claim 10, wherein feeding of the structural antenna takes place by way of a symmetrical ground-free feeding line while using a $\lambda/4$ stub sleeve balun.

12. The structural antenna according to claim 11, wherein a metallic area, which is arranged within the structural antenna in a center with respect to the conductive area, is connected with an exterior conductor of the $\lambda/4$ stub sleeve balun and the folding edge.

13. The structural antenna according to claim 11, wherein the conductive area of the structural antenna is fed symmetrically by way of potential-carrying connections and of the symmetrical ground-free feeding line.

14. The structural antenna according to claim 2, wherein the conductive area is insulated with respect to a conductive surface surrounding the structural antenna which is arranged on the non-conductive layer.

15. The structural antenna according to claim 14, wherein feeding of the structural antenna takes place by way of a symmetrical ground-free feeding line while using a $\lambda/4$ stub sleeve balun.

16. The structural antenna according to claim 15, wherein a metallic area, which is arranged within the structural antenna in a center with respect to the conductive area, is connected with an exterior conductor of the $\lambda/4$ stub sleeve balun and the folding edge.

17. The structural antenna according to claim 15, wherein the conductive area of the structural antenna is fed symmetrically by way of potential-carrying connections and of the symmetrical ground-free feeding line.

* * * * *